US008191479B2

(12) United States Patent
Ruhlman et al.

(10) Patent No.: US 8,191,479 B2
(45) Date of Patent: Jun. 5, 2012

(54) REDUCED COLLATERAL DAMAGE BOMB (RCDB) INCLUDING FUSE SYSTEM WITH SHAPED CHARGES AND A SYSTEM AND METHOD OF MAKING SAME

(76) Inventors: James D. Ruhlman, Santa Rosa Beach, FL (US); Blake K. Thomas, Ashton, MD (US)

( * ) Notice: Subject to any disclaimer, the term of this patent is extended or adjusted under 35 U.S.C. 154(b) by 335 days.

(21) Appl. No.: 11/961,844

(22) Filed: Dec. 20, 2007

(65) Prior Publication Data

US 2010/0263566 A1 Oct. 21, 2010

Related U.S. Application Data

(60) Provisional application No. 60/875,994, filed on Dec. 20, 2006.

(51) Int. Cl.
*F42B 25/00* (2006.01)

(52) U.S. Cl. ..... 102/396; 102/473; 102/476; 102/265; 102/200; 102/499

(58) Field of Classification Search ..... 102/473, 102/476, 396, 265, 200, 499
See application file for complete search history.

(56) References Cited

U.S. PATENT DOCUMENTS

| | | | | |
|---|---|---|---|---|
| 3,648,610 | A | | 3/1972 | van Zyl et al. |
| 3,664,262 | A | | 5/1972 | Rose et al. |
| 3,693,548 | A | | 9/1972 | Dereich et al. |
| 3,797,391 | A | | 3/1974 | Cammarata et al. |
| 3,853,059 | A | | 12/1974 | Moe |
| 4,058,063 | A | | 11/1977 | Hurst |
| 4,145,972 | A | | 3/1979 | Menz et al. |
| 4,152,987 | A | | 5/1979 | Lundstrom et al. |
| 4,448,129 | A | | 5/1984 | Gabriels |
| 4,499,830 | A | | 2/1985 | Majerus et al. |
| 4,612,859 | A | | 9/1986 | Furch et al. |
| 4,615,272 | A | | 10/1986 | Aubert |
| 4,711,177 | A | * | 12/1987 | Foster et al. ..... 102/204 |
| 4,776,272 | A | | 10/1988 | Lindstadt et al. |
| 4,860,659 | A | | 8/1989 | Andreetta |
| 5,054,399 | A | | 10/1991 | Bilek et al. |
| 5,305,505 | A | | 4/1994 | Ruhlman |
| 5,370,055 | A | | 12/1994 | Fugelso et al. |
| 5,509,357 | A | | 4/1996 | Lawther |
| 5,515,785 | A | | 5/1996 | Zglenicki |
| 5,524,543 | A | * | 6/1996 | Kerdraon ..... 102/204 |
| 5,792,977 | A | | 8/1998 | Chawla |

(Continued)

OTHER PUBLICATIONS

International Search Report and Written Opinion, International Application No. PCT/US2007/088449, Sep. 29, 2008, 8 pages.

(Continued)

*Primary Examiner* — J. Woodrow Eldred
(74) *Attorney, Agent, or Firm* — Wilmer Cutler Pickering Hale and Dorr LLP

(57) ABSTRACT

A reduced collateral damage bomb (RCDB) bomb casing is described and disclosed along with the system and method for making it. The RCDB bomb casing may be formed from conventional or penetrating warhead bomb casings. The RCDB bomb casing has a filler material/materials disposed on the interior walls that will assist in controlling the collateral damage caused by the finished bomb but not prevent the appropriate destructive power being delivered to a selected target. Further, the fusing system may include a shaped charge to control the ignition of the main explosive charge to control the amount of collateral damage when the bomb casing is filled with high explosives.

15 Claims, 15 Drawing Sheets

U.S. PATENT DOCUMENTS

| | | | | |
|---|---|---|---|---|
| 5,852,256 | A | 12/1998 | Hornig | |
| 5,939,662 | A | 8/1999 | Bootes et al. | |
| 6,105,505 | A | 8/2000 | Jones | |
| 6,227,119 | B1 | 5/2001 | Schmacker | |
| 6,393,991 | B1 * | 5/2002 | Funston et al. | 102/476 |
| 7,472,653 | B1 | 1/2009 | Hays et al. | |
| 7,845,282 | B2 | 12/2010 | Sheridan et al. | |
| 7,926,423 | B2 * | 4/2011 | Rickman et al. | 102/314 |
| 7,992,498 | B2 | 8/2011 | Ruhlman et al. | |
| 2002/0069784 | A1 | 6/2002 | Landman et al. | |
| 2007/0051267 | A1 | 3/2007 | Meddes et al. | |
| 2011/0041720 | A1 * | 2/2011 | Brill et al. | 102/266 |

OTHER PUBLICATIONS

International Search Report and Written Opinion for International Application No. PCT/US07/76757 mailed Sep. 22, 2008. 8 pages.

International Search Report and Written Opinion for International Application No. PCT/US08/71648 mailed Mar. 13, 2009. 5 pages.

* cited by examiner

REDUCED COLLATERAL DAMAGE BOMB (RCDB) INCLUDING FUSE SYSTEM WITH SHAPED CHARGES AND A SYSTEM AND METHOD OF MAKING SAME

CROSS REFERENCE TO RELATED APPLICATIONS

This application claims the priority under 35 U.S.C. §119 (e) of U.S. Provisional Application No. 60/875,994, filed Dec. 20, 2006, which is incorporated herein by reference.

TECHNICAL FIELD

The present invention relates generally to bombs that are used to deliver high explosives to selected targets. More specifically, the present invention relates to bombs that deliver high explosives to selected targets but have the capability to reduce unwanted collateral damage.

BACKGROUND OF THE INVENTION

Bombs can have bomb casing of a conventional or penetrating warhead (PW) type. "Conventional" as it is used herein in describing a bomb casing means the shape and characteristics of the bomb casing as would be understood in the bomb industry.

Typically, bomb casings are filled with high explosive material and an end cap is used to seal the open end. Finished bombs using these bomb casings may be in 250, 500, 1000, and 2000 lb. classes or larger. The selection of the particular class of bomb will depend on the amount of high explosive that needs to be delivered to a selected target. Such bombs have been in the U.S. weapons inventory for a number of years.

Conventional and PW bomb casings each have a prescribed wall thickness. For any given bomb pound class, the interior cavity of the bomb casing will be tightly filled with high explosive material so that the finished bomb of a particular class will deliver predictable destructive power to a selected target. If the destructive power were not predictable, there is a strong likelihood either the appropriate destructive power will not be delivered to a target or excessive power will be delivered, but in each case there will be a waste of resources.

As is reported many times in the media when bombs are used, there is a problem with the amount of collateral damage near where such bombs are delivered to selected targets. The collateral damage may be to structures in the immediate area or to the civilian population. Therefore, it would be optimal for bombs to deliver high explosives to the selected target and not inflict undesired collateral damage unless that was the intention.

It is understood in the bomb industry that just reducing the size of the bomb, for example, from a 1000 to 500 lb. class bomb to reduce collateral damage may mean that collateral damage is reduced but there are other problems. The typical problem is that the smaller bomb may be inadequate to destroy the selected target because the mass of the 1000-pound class bomb may still be needed for target destruction.

There is desire for bombs of any class to have a reduced collateral damage capability yet not reduce the effectiveness of the bomb to deliver predictable destructive power for the destruction of the selected target.

SUMMARY OF THE INVENTION

The present invention is directed to bombs in which the collateral damage may be controlled. This may be carried out generally by two methods. A first method is through the use of a novel type of reduced collateral damage bomb (RCDB) casing. The RCDB casings according to this method may be constructed with a filler material applied to its interior walls. This filler material is applied in a controlled manner to reduce the volume of the cavity within the bomb casing. The remaining interior cavity of the bomb casing is then filled with high explosive material. A second method is through use of a fuse system that has a fuse booster that is a shaped charge. When such a fuse system is employed in a conventional bomb or penetrating warhead casing that is filled with high explosives, the shaped charge will control the ignition of the main high explosive charge, the collateral damage caused by the bomb.

According to a first method, the filler material is typically a material that is inert to the high explosive material even if the bombs are stored for a period of time. The filler material also may have properties that assist in providing destructive power to the bomb, but still reduce the collateral damage of the bomb.

According to the second method, the fuse system uses shaped charges of various shapes to detonate the main high explosive charge. As stated, these various shapes of the shaped charges will cause specific types of detonations to achieve the desired type of collateral damage but the selected shapes will also take into account the type of high explosive that is being used and the different types of fuse liners that are used for the shaped charges.

An object of the present invention is to provide a conventional or PW bomb casing that will reduce the collateral damage of the finished bomb when it is delivered to a selected target.

Another object of the present invention is to provide a conventional or PW bomb casing that has a filler material coated on the interior walls that assists in reducing the collateral damage of the finished bomb when it is delivered to a selected target.

A further object of the present invention is to provide a conventional or PW bomb casing that has a filler material coated on the interior walls that has properties to enhance the destructive power of the bomb but with a reduced collateral damage effect.

A yet further object of the present invention is to provide a bomb that controls the collateral damage by the fuse system employing various types of shaped charges to controllably ignite the main high explosive charge of the bomb to control the collateral damage of the bomb.

These and other objects will be described in greater detail in the remainder of the specification referring to the drawings.

DESCRIPTION OF THE PRESENT INVENTION

The present invention is directed to embodiments of a reduced collateral damage bomb (RCDB) casing and the system and method of making such bombs. In a first embodiment of the present invention, a RCDB bomb casing has a filler material disposed on the interior walls of the interior cavity that will assist in controlling the collateral damage caused by the bomb but not prevent the appropriate destructive power from being delivered to a selected target. In a second embodiment of the present invention, the RCDB casing is filled with high explosives but it has a fuse system that includes a shaped charge for controlling the ignition of the main high explosive charge and, therefore, the collateral damage of the bomb.

RCDB Casings with Filler Material

Figure 3:
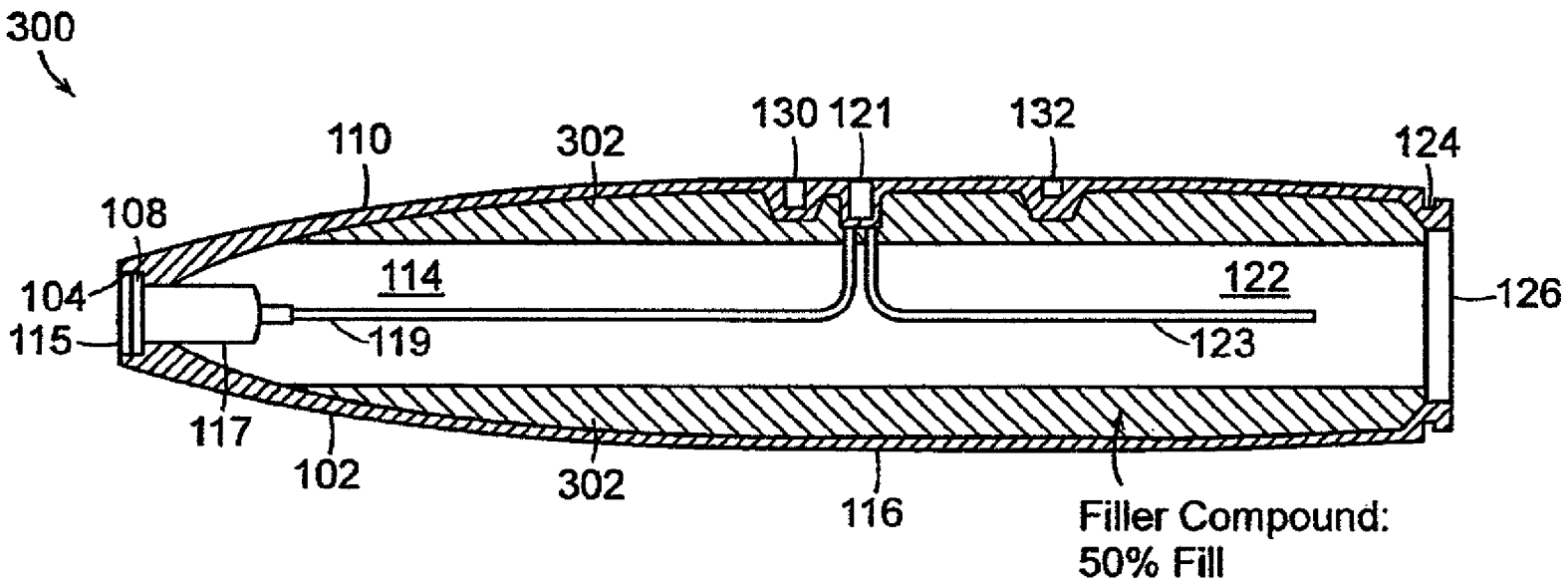
FIGS. 3 and 4 show cross-sectional views of an embodiment of a conventional bomb casing (without the aft fuze liner or closure components) that has different thickness of filler material coating the interior walls of the internal cavity according to the present invention.
Figure 4:
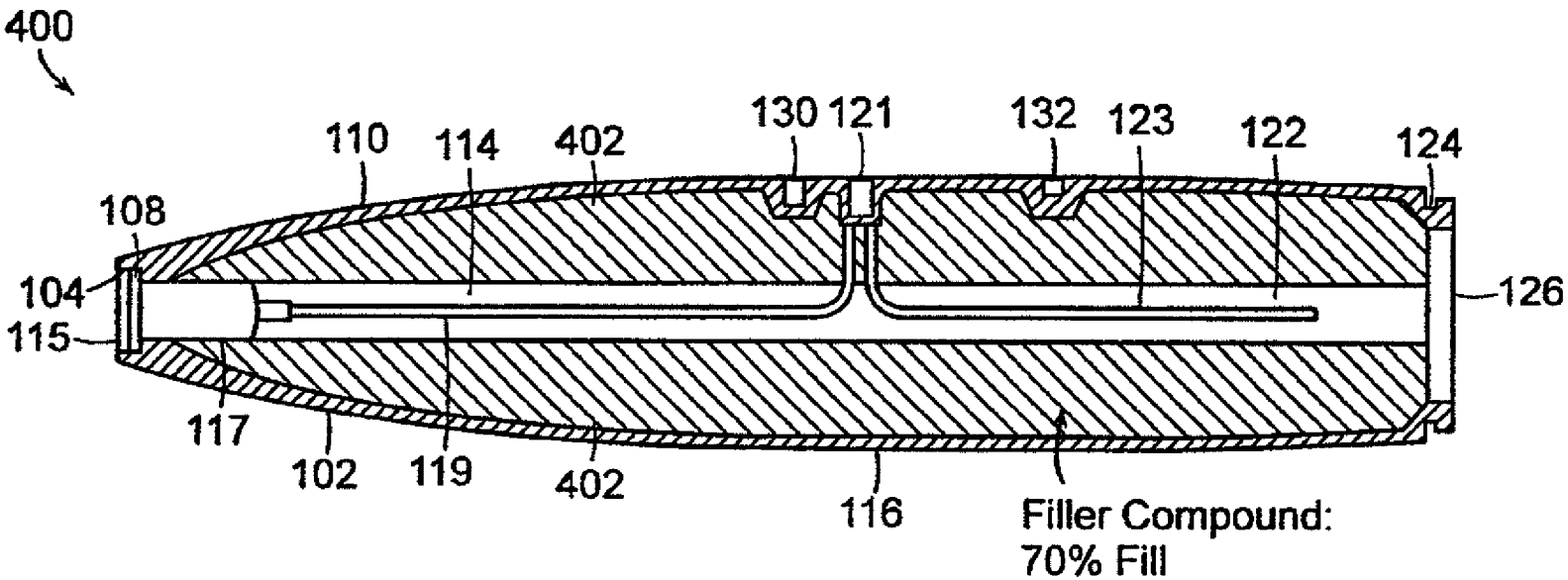

An embodiment of a RCDB conventional bomb casing according to the present invention is shown at FIGS. 3 and 4. With respect to FIGS. 3 and 4, the conventional bomb casing that is shown is the conventional bomb casing of FIG. 1 and, therefore, the conventional bomb casing has the same reference numbers. The differences in the reference numbers between what is shown in FIG. 1, and FIGS. 3 and 4 are what has been added according the present invention to make the conventional bomb casing a RCDB conventional bomb casing.

Figure 1:
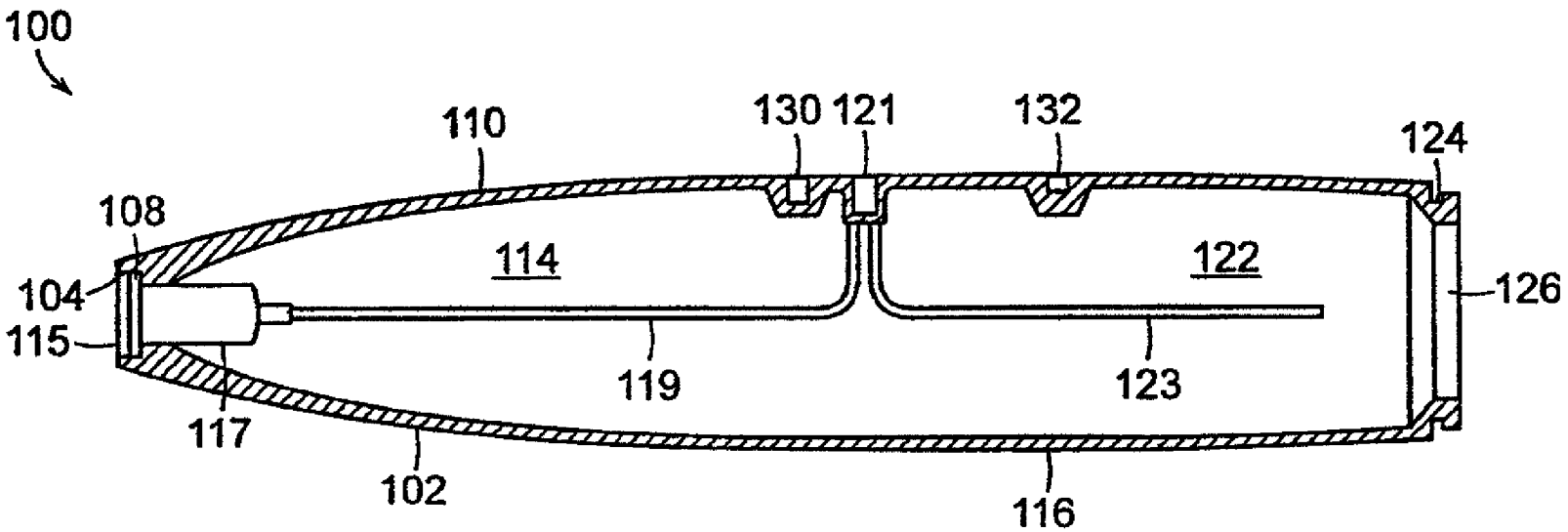
FIG. 1 (Prior Art)
FIG. 1 shows a cross-sectional view of a conventional bomb casing (without the aft fuze liner or closure components) that does not incorporate the present invention.

FIG. 1, generally at 100, shows a cross-sectional view of a conventional bomb casing, for example, for Mark 80 series bomb bodies. The bomb casing includes ogive-shaped, front section 102 and cylindrical-shaped, rear section 116. The bomb casing, preferably, is made of a low carbon steel 10XX, 41XX low alloy or for a specific application can be made of a high strength alloy steel, such as a 43XX alloy or higher strength material.

Ogive-shaped, front section 102 and cylindrical-shaped, rear section 116 may be formed separately or as a single unit and still be within the scope of the present invention.

The wall thickness of ogive-shaped, front section 102 progressively increases from rear edge 110 of this section to front end 104. Threaded bore 108 is disposed in front end 104 and extends through the front end wall thickness to central opening 114 in ogive-shaped, front section 102. Threaded bore 108 receives threaded bomb nose plug (not shown) in a screw-nut relationship. Nose fuze liner 117 is shown that will receive the proximal end of the nose plug at 115.

Preferably, cylindrical-shaped, rear section 116 has a substantially uniform wall thickness, except at rear end 124. The wall thickness of the cylindrical-shaped, rear section is substantially the same as the wall thickness of ogive-shaped, front section 102 at rear edge 110. The cylindrical-shaped, rear section has central opening 122. The combination of central opening 114 in ogive-shaped, front section 102 and central opening 122 in cylindrical-shaped, rear section 116 form the interior cavity of bomb casing 102.

Cylindrical-shaped, rear section 116 has threaded bores 130 and 132. Each of the threaded bores receives the threaded base of a suspension lug (not shown). The suspension lugs are used for lifting the finished bombs and attaching them to aircraft bomb racks.

Cylindrical-shaped, rear section 116 also has charging receptacle 121. Charging tube 119 connects between charging receptacle 121 and nose fuze liner 117. Charging tube 123 connects between charging receptacle 121 and a tail fuze liner (not shown).

End 124 of cylindrical-shaped, rear section 116 has opening 126 that receives an aft-end fuze liner and closure structure (not shown). The aft-end closure structure holds the tail fuze liner. A fin assembly (not shown) attaches to the aft-end closure structure 124. In the finished bomb, the interior cavity of the bomb casing is filled with high explosive material.

Figure 2:
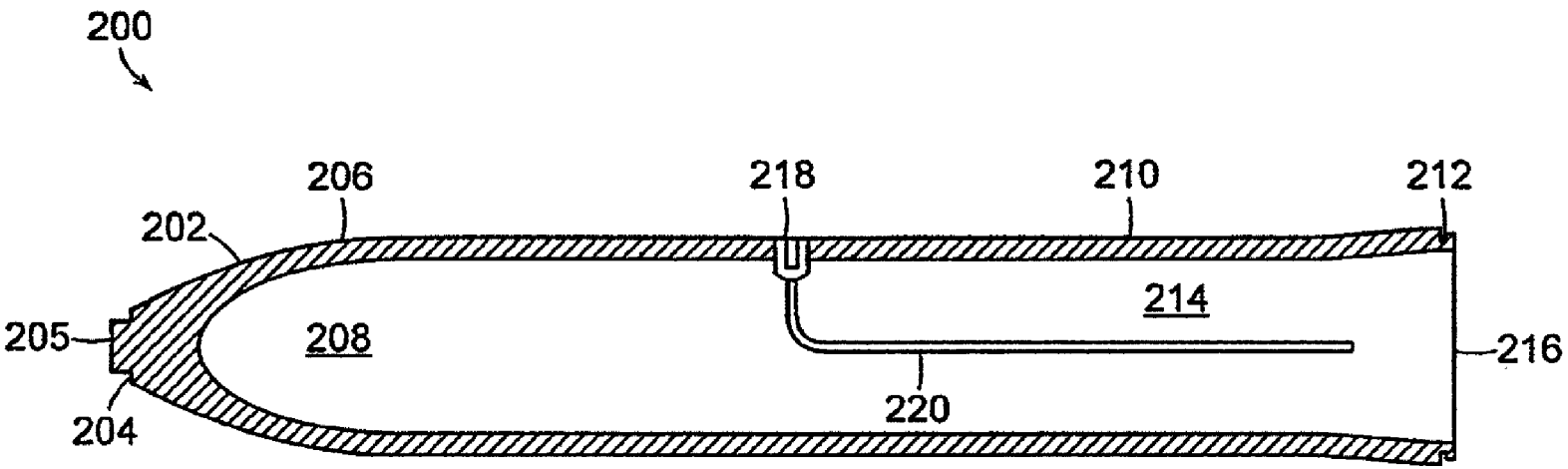
FIG. 2 (Prior Art)
FIG. 2 shows a cross-sectional view of a conventional penetrating warhead bomb casing (without the aft fuze liner or closure components) that does not incorporate the present invention.

FIG. 2, generally at 200, shows a penetrating warhead ("PW") bomb casing that is currently available in a variety of sizes from 250 lbs. to over 5000 lbs. The casing can have an ogive-shaped, front section 202 and cylindrical-shaped, rear section 210. The bomb casing, preferably, is made of a high strength alloy steel, such as a 43XX or higher strength material.

The nose shape shown is ogive-shaped, front section 202 and cylindrical-shaped, rear section 210 may be formed separately or as a single unit and still be within the scope of the present invention.

The nose shape shown is ogive-shaped, front section 202 has a wall thickness that progressively increases from rear edge 206 of this section to forward end 204. The ogive-shaped, front section has central opening 208. Front end 204 of ogive-shaped, front section 202 has threaded nose portion 205 extending from it. Threaded nose portion 205 is for receiving a retaining ring of a guidance kit (not shown) in a threaded relationship.

Preferably, cylindrical-shaped, rear section 210 has a substantially uniform wall thickness, except at rear end 212. The wall thickness of the cylindrical-shaped, rear section is substantially the same as the wall thickness of ogive-shaped, front section 202 at rear edge 206. The cylindrical-shaped, rear section has central opening 214. The combination of central opening 208 and central opening 214 form the interior cavity of bomb casing 202.

Cylindrical-shaped, rear section 210 has charging receptacle 218. Charging tube 220 connects between charging receptacle 218 and a tail fuze liner (not shown). This charge tube is eliminated on some PW. End 212 of cylindrical-shaped, rear section 210 has opening 216 that receives the fuze liner and aft-end closure structure (not shown). The aft-end closure structure holds the tail fuze liner. A fin assembly (not shown) attaches to aft-end closure structure 212. In the finished bomb, the interior cavity of the bomb casing is filled with high explosive material.

Although not shown in FIG. 2, cylindrical-shaped, rear section 210 may have an assembly attached to it for receiving the threaded bases of two or more suspension lugs (not shown). The suspension lugs, as stated, are used for lifting the finished bombs and attaching them to aircraft wing bomb mounts.

Referring to FIG. 3, a RCDB conventional bomb casing is shown generally at 300. The RCDB conventional bomb casing has ogive-shaped, front section 102 and cylindrical-shaped, rear section 116. Ogive-shaped, front section 102 has a wall thickness that progressively increases from rear edge 110 to forward end 104. Threaded bore 108 is disposed in front end 104 and extends through the front end wall thickness to central opening 114 in ogive-shaped, front section 102.

Cylindrical-shaped, rear section 116 has a substantially uniform wall thickness, except at rear end 124. The wall thickness of the cylindrical-shaped, rear section is substantially the same as the wall thickness of ogive-shaped, front section 102 at rear edge 110. The cylindrical-shaped, rear section has central opening 122. Cylindrical-shaped, rear section 116 has threaded bores 130 and 132 for the threaded bases of suspension lugs. Cylindrical-shaped, rear section 116 also has charging receptacle 121. Charging tube 119 connects between charging receptacle 121 and nose fuze liner 117. Charging tube 123 connects between charging receptacle 121 and a tail fuze liner (not shown). End 124 of cylindrical-shaped, rear section 116 has opening 126 that receives an aft-end closure structure. The aft-end closure structure holds the tail fuze liner.

According to the present invention, filler material 302 is spin coated on the interior walls of the interior cavity formed by central openings 114 and 122. The filler material will reduce the volume of the interior cavity, thereby reducing the side explosive impact of the finished bomb.

The filler material is an inert compound that will not react with the explosive material and reduce its explosive potential. The filler material although inert also may have properties that will enhance the explosive capability of the bomb when compared to a bomb that has an explosively neutral filler material. Whether the filler material is explosively neutral or will enhance the explosive capability, the finished bomb that includes filler material will reduce collateral damage.

Again referring to FIG. 3 at 300, the conventional bomb casing that includes ogive-shaped, front section 102 and cylindrical-shaped, rear section 116 has a spin coating of filler material applied to the interior walls to a thickness that reduces the interior cavity volume by 50%. Preferably, the spin coating of filler material is distributed in a manner to form an interior cylindrical channel along the longitudinal axis of the bomb casing. The cylindrical channel has a substantially uniform diameter. The cylindrical channel will be filled with high explosive material. The filler material will help focus the destructive power of the bomb through the front of the finished bomb while reducing the channeling of the destructive power out from the sides of the bomb.

Referring to FIG. 4, a RCDB conventional bomb casing is shown generally at 400. The RCDB conventional bomb casing that is shown in FIG. 4 differs from the RCDB conventional bomb casing in FIG. 3 in that filler material 402 is spin coated on the interior walls to a thickness that reduces the interior cavity volume of the bomb casing by 70% rather than 50%. The other features of the filler material as described for the RCDB conventional bomb casing shown in FIG. 3 apply equally to FIG. 4 and are incorporated here by reference.

Figure 5:
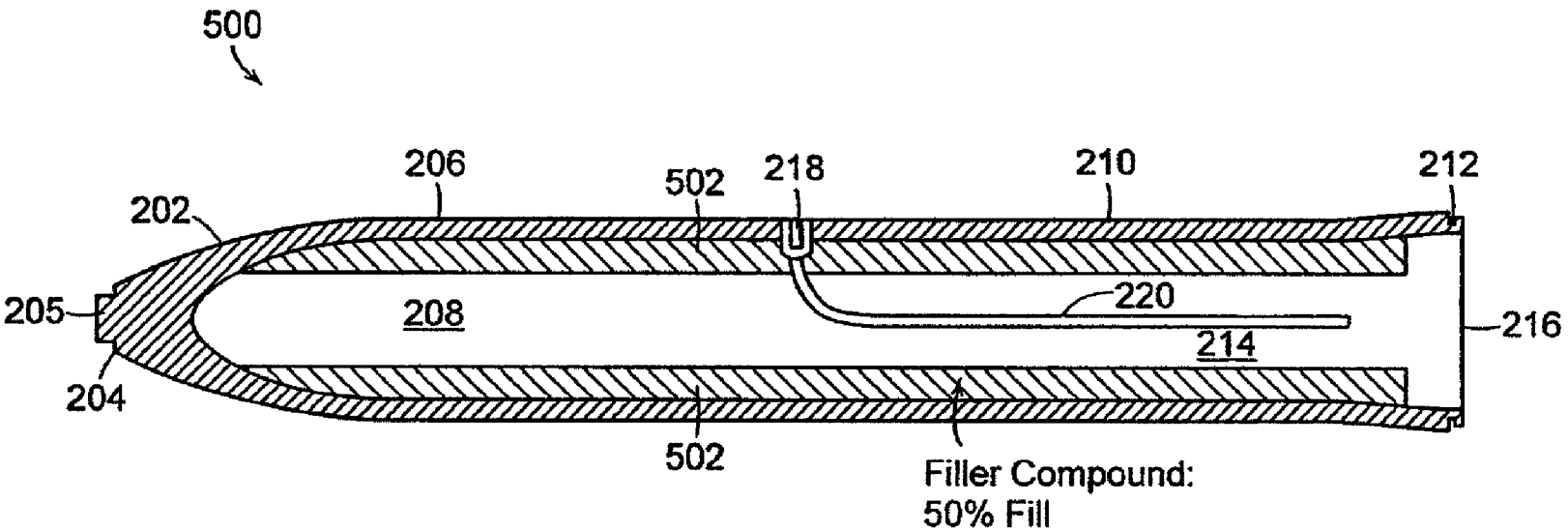
FIGS. 5 and 6 show cross-sectional views of an embodiment of a PW bomb casing (without the aft fuze liner or closure components) that has different thickness of filler material coating the interior walls of the interior cavity according to the present invention.
Figure 6:
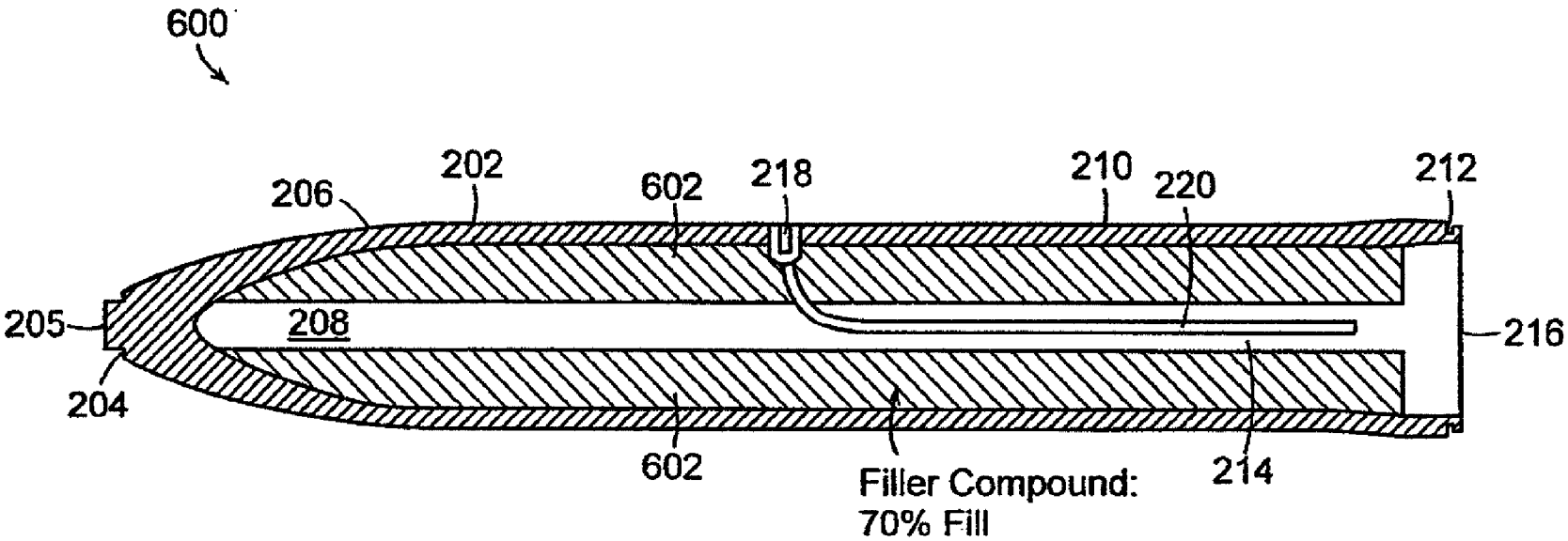

An embodiment of a RCDB PW bomb casing according to the present invention is shown at FIGS. 5 and 6. With respect to FIGS. 5 and 6, the PW bomb casing that is shown is the PW bomb casing of FIG. 2 and, therefore, the PW bomb casing has the same reference numbers. The differences in the reference numbers between what is shown in FIG. 2, and FIGS. 5 and 6 are what has been added according to the present invention to make the PW bomb casing a RCDB PW bomb casing.

Referring to FIG. 5, a RCDB PW bomb casing is shown generally at 500. The RCDB PW bomb casing has ogive-shaped, front section 202 and cylindrical-shaped, rear section 210. Ogive-shaped, front section 202 has a wall thickness that progressively increases from rear edge 206 of this section to forward end 204. The ogive-shaped, front section has central opening 208. Front end 204 of ogive-shaped, front section 202 has threaded nose portion 205 extending from it.

Cylindrical-shaped, rear section 210 has a substantially uniform wall thickness, except at rear end 212. The wall thickness of the cylindrical-shape, rear section is substantially the same as the wall thickness of the ogive-shaped, front section at rear edge 206. The cylindrical-shaped, rear section has central opening 214. Cylindrical-shaped, rear section 210 has charging receptacle 218 to which charging tube 220 connects. End 212 of cylindrical-shaped, rear section 210 has opening 216 that receives an aft-end closure structure (not shown). The aft-end closure structure holds the tail fuze liner.

According to the present invention, filler material 502 is spin coated on the interior walls of the interior cavity formed by central openings 208 and 214. The filler material will reduce the volume of the interior cavity that receives the high explosive material.

As stated with respect to FIGS. 3 and 4, filler material 502 preferably is an inert compound that will not react with the explosive material and reduce its explosive potential. Filler material 502 although inert also may have properties that will enhance the explosive capability of the bomb when compared to a bomb that has an explosively neutral filler material. Whether the filler material is explosively neutral or will enhance the explosive capability, the bomb will have reduced collateral damage.

Again referring to FIG. 5 at 500, the PW bomb casing that includes ogive-shaped, front section 202 and cylindrical-shaped, rear section 210 has a spin coating of filler material applied to the interior walls to a thickness that reduces the interior cavity volume by 50%. Preferably, the spin coating of filler material is distributed in a manner to form an interior cylindrical channel along the longitudinal axis of the bomb casing. The cylindrical channel has a substantially uniform diameter. The cylindrical channel will be filled with high explosive material. The filler material will help focus the destructive power of the bomb through the aft-end of the bomb while reducing the channeling of the destructive power out from the sides of the bomb. This application could be applied when the kinetic energy required to penetrate a structure requires the weight but the internal void only required a low volume of high explosive to neutralize the target.

Referring to FIG. 6, a RCDB PW bomb casing is shown generally at 600. The RCDB PW bomb casing that is shown in FIG. 6 differs from the RCDB PW bomb casing in FIG. 5 in that filler material 602 is spin coated on the interior walls to a thickness that reduces the interior cavity volume of the bomb casing by 70% rather than 50%. The other features of the filler material as previously described for the RCDB PW bomb casing shown in FIG. 5 apply equally to FIG. 6 and are incorporated here by reference.

Referring to FIGS. 3, 4, 5, and 6, the filler material shown at 302, 402, 502, and 602, respectively, that is spin coated on the interior walls of the interior cavity has weight properties substantially similar to those of the explosive material it replaces. This is so the finished bomb will have substantially the same weight, center of gravity, moment of inertia, and aerodynamic properties as a bomb filled only with high explosive material.

When the filler material, such as that shown at 302, 402, 502, and 602 is added within the bomb casings, the resulting RCDB will provide a predictable level of reduced collateral damage destructive power. As such, bombs formed according to the present invention that include filler material may have a thickness of the filler material that will change according to the amount of high explosive material needed to be delivered to a selected target to destroy it but minimize undesired collateral damage near the target.

The filler material preferably will fill 25%-75% of the interior cavity volume of the bomb casing when it is spin-coated on the interior walls. The filler material will have properties that will permit it to adhere to the walls and itself when spin-coated on and cured. Preferably, the filler material will be explosively neutral or be a composite material that will provide special destructive characteristics to enhance the bomb's destructive capabilities. For example, the filler materials may include a combination of heavier and lighter materials that per unit volume is equivalent to the high explosive material it replaces. Examples of explosively inert, i.e., explosively neutral, filler material are polymer materials that use binders that will not interact with (or is inert to) the high explosive material. Further, examples of inert explosive enhancing filler materials are ones in which the polymer material with binders also has beads added to it that contain elements, such as oxygen, that can be desirable when such beads are used in an enclosed environment or such materials as tungsten or aluminum are added to create special desired effects.

Figure 7A:
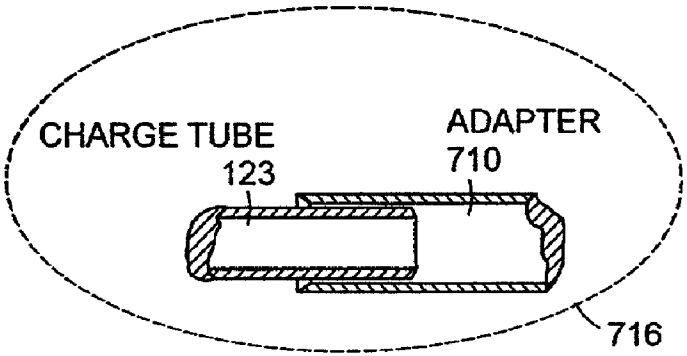
FIGS. 7A and 7B show a conventional bomb casing for describing the method of spin coating a filler material on interior walls of the interior cavity according to the present invention.
Figure 7B:
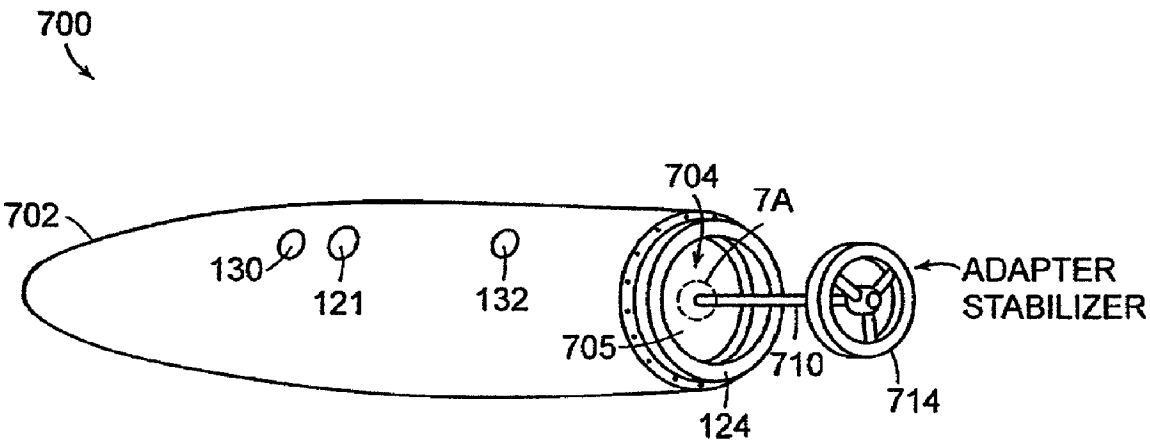
Figure 8A:
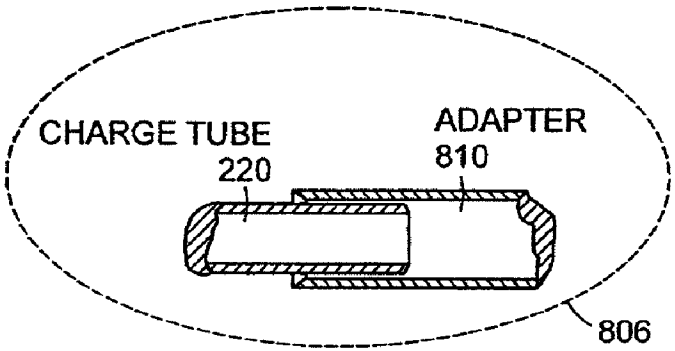
FIGS. 8A and 8B show a PW bomb casing for describing the method of spin coating a filler material on interior walls of the interior cavity according to the present invention.
Figure 8B:
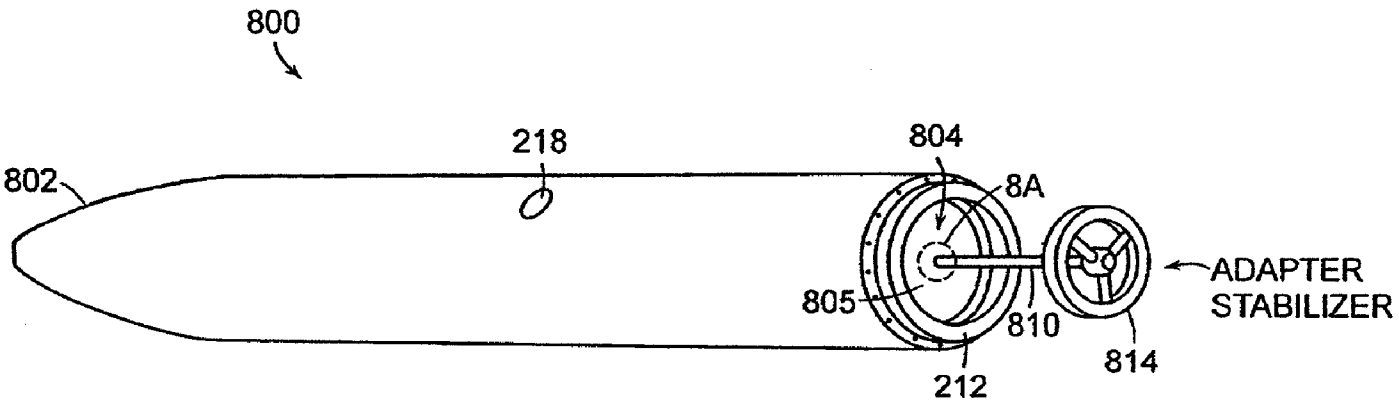

FIG. 7, generally at 700, and FIG. 8, generally at 800, will be used to describe the method of the present invention for forming the RCDB bomb casings of the present invention. The method of the present invention is substantially the same for both types of bomb casings, conventional and PW. Accordingly, in describing the method, the reference number for the conventional bomb casing in FIG. 7 will be given first then the corresponding reference number for the PW bomb casing in FIG. 8 will be given.

Open-ended bomb casing 702/802 is obtained that is desired to transform into a RCDB bomb casing. Charge tube stabilizer 704/804 is used to support and stabilize the charge tube 124/212 of bomb casing 702/802. Charge tube stabilizer 704/804 includes seal 705/805 that is inserted into the aft-end to control the level of the inert filler material that is added into the bomb casing. Charge tube stabilizer 704/804 has adapter tube 710/810 extending though it that has a length within the interior cavity of bomb casing 702/802 to extend over the end of charge tube 123/220, as shown at 706/806. This will prevent filler material from fouling the charge tube during the spin coating process. Further, adapter tube 710/810 also extends outward from seal 705/805 a length, and the distal end of the adapter tube connects to a spin stabilizer wheel 714/814. The adapter and spin stabilizer wheel will stabilize the charge tube 123/220 during the filler material spin coating process.

After level controlling seal 705/805 and adapter tube 710/810 with spin stabilizer wheel 714/814 are in place, bomb casing 702/802, preferably, is placed in a variable speed horizontal centrifugal casting machine. The machine will have counterbalancing capabilities to provide an offset for the inserts, which are known in the industry, e.g., a gyro-based system, and inert filler material while the machine is coming up to the speed required to spin coat the inert filler material on the bomb casing walls. It is understood that other machines may be used that are capable of spinning the bomb casing and still be within the scope of the present invention.

The next step of the process is to insert a spout from a hopper containing the filler material with the binder and other desired materials being mixed thereto into the bomb casing through the open spoke spin stabilizer wheel at the aft-end of the item. The amount of filler material that is poured into the interior cavity of bomb casing 702/802 is calculated to provide a desired thickness on the interior walls of the bomb casing and form the previously discussed cylindrical channel. This amount will allow the finished bomb to provide the desired destructive power to the selected target and reduce the collateral damage.

Bomb casing 702/802 that is filled with the desired amount of filler material is spun at a predetermined speed for a predetermined period of time to spin coat the interior walls of the interior cavity with filler material. The spin coating will form a cylindrical channel within the bomb casings as shown, for example, in FIGS. 3 and 5. While bomb casing 702/802 is being spun, the exterior of the bomb casing can be heated to cure the filler material as it spin coats the interior walls of the bomb casing.

Following spin coating and curing the filler material to the interior walls of bomb casing 702/802, the bomb casing is removed from the casting machine. Next, seal 705/805 is removed, which also results in adapter tube 710/810, along with spin stabilizer wheel 714/814, being removed from the end of charge tube 123/220. Bomb casing 102/202 may now be made ready for normal processing into a finished bomb.

RCDB Casing with Shaped Charge Fuse System

Figure 9:
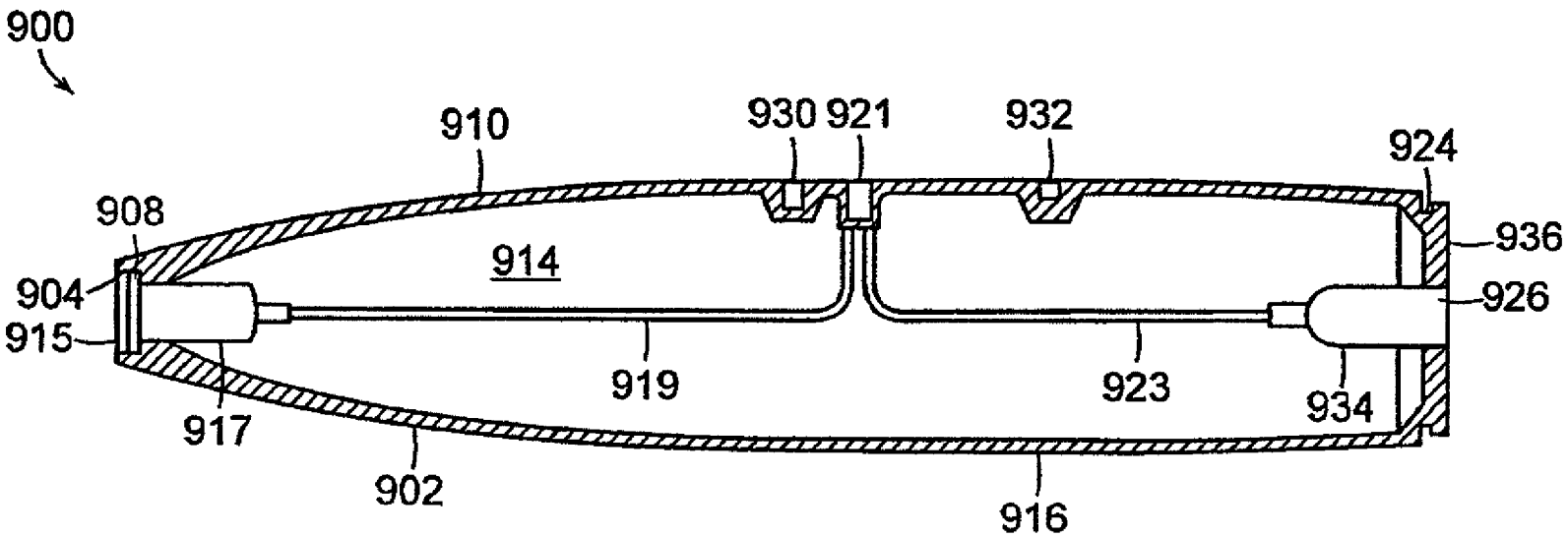
FIG. 9 shows a cross-section of a conventional bomb casing that is filled with high explosives with a fuse system in the nose and tail sections.

Referring to FIG. 9, generally at 900, a cross-sectional view of a conventional bomb casing is shown. The conventional bomb casing at 900, for example, may be a Mark 80 series bomb body. Similar to FIG. 1, the bomb casing includes ogive-shaped, front section 902 and cylindrical-shaped, rear section 916. The bomb casing, preferably, is made of a low carbon steel 10XX, 41XX low alloy or for a specific application can be made of a high strength alloy steel, such as a 43XX alloy or higher strength material.

Ogive-shaped, front section 902 and cylindrical-shaped, rear section 916 may be formed separately or as a single unit and still be within the scope of the present invention.

The wall thickness of ogive-shaped, front section 902 progressively increases from rear edge 910 of this section to front end 904. Threaded bore 908 is disposed in front end 904 and extends through the front end wall thickness to central opening 914 in ogive-shaped, front section 902. Threaded bore 908 receives threaded bomb nose plug (not shown) in a screw-nut relationship. Nose fuze system 917 is shown that will receive the proximal end of the nose plug at 915.

Preferably, cylindrical-shaped, rear section 916 has a substantially uniform wall thickness, except at rear end 924. The wall thickness of the cylindrical-shaped, rear section is substantially the same as the wall thickness of ogive-shaped, front section 902 at rear edge 910. The cylindrical-shaped, rear section has central opening 922. The combination of central opening 914 in ogive-shaped, front section 902 and central opening 922 in cylindrical-shaped, rear section 916 form the interior cavity of bomb casing 902. The interior cavity a bomb casing 902 is filled with high explosives.

Cylindrical-shaped, rear section 916 has threaded bores 930 and 932. Each of the threaded bores receives the threaded base of a suspension lug (not shown). The suspension lugs are used for lifting the finished bombs and attaching them to aircraft bomb racks.

Cylindrical-shaped, rear section 916 also has charging receptacle 921. Charging tube 919 connects between charging receptacle 921 and nose fuze system 917. Charging tube 923 connects between charging receptacle 921 and tail fuze system 934.

End 924 of cylindrical-shaped, rear section 916 has threaded opening 926 that receives tail fuze system 934 and closure structure 936 that preferably is threaded into opening 926. A fin assembly (not shown) attaches to the aft-end closure structure 924. In the finished bomb, as stated, the interior cavity of the bomb casing is filled with high explosive material.

Figure 10:
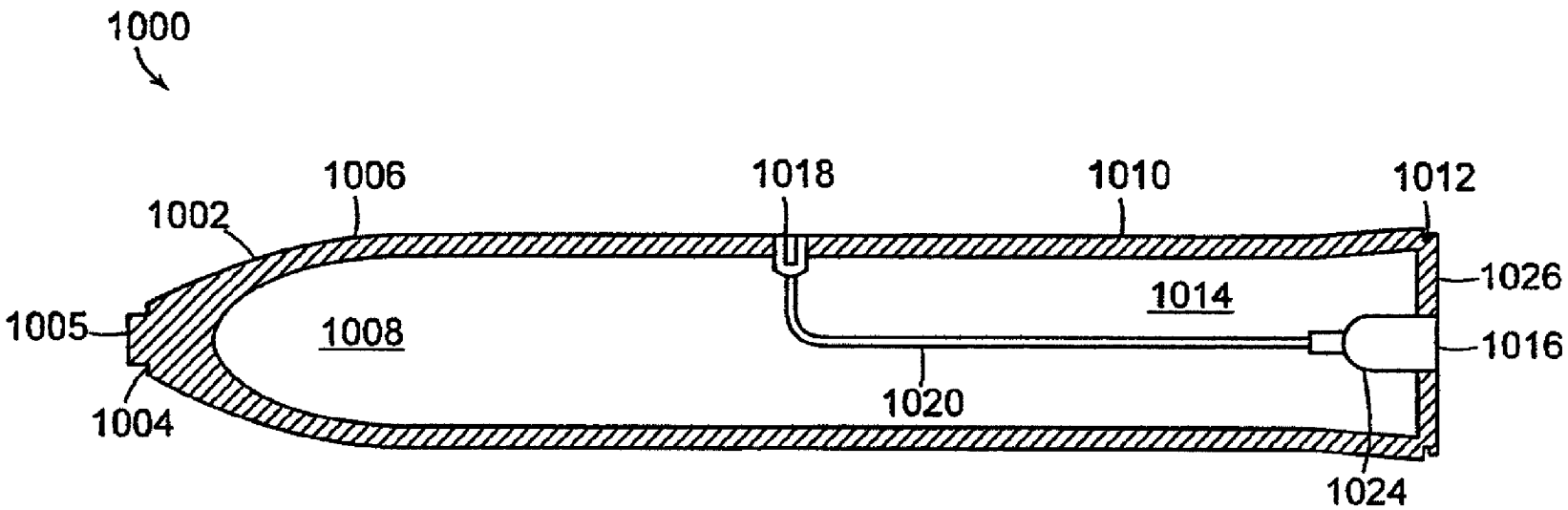
FIG. 10 shows a cross-sectional view of a conventional penetrating warhead bomb casing with a fuse system in tail section.

FIG. 10, generally 1000, shows a PW bomb casing that is currently available in a variety of sizes from 250 lbs. to over 5000 lbs. Similar to the casing shown in FIG. 2, the casing can have an ogive-shaped, front section 1002 and cylindrical-shaped, rear section 1010. The bomb casing, preferably, is made of a high strength alloy steel, such as a 43XX or higher strength material The nose shape shown is ogive-shaped, front section 1002 and cylindrical-shaped, rear section 1010 may be formed separately or as a single unit and still be within the scope of the present invention.

The nose shape shown is ogive-shaped, front section 1002 has a wall thickness that progressively increases from rear edge 1006 of this section to forward end 1004. The ogive-shaped, front section has central opening 1008. Front end 1004 of ogive-shaped, front section 1002 has threaded nose portion 1005 extending from it. Threaded nose portion 1005 is for receiving a retaining ring of a guidance kit (not shown) in a threaded relationship.

Preferably, cylindrical-shaped, rear section 1010 has a substantially uniform wall thickness, except at rear end 1012. The wall thickness of the cylindrical-shaped, rear section is substantially the same as the wall thickness of ogive-shaped, front section 1002 at rear edge 1006. The cylindrical-shaped, rear section has central opening 1014. The combination of central opening 1008 and central opening 1014 form the interior cavity of bomb casing 1002. This interior cavity of the bomb casing is filled with high explosives.

Cylindrical-shaped, rear section 1010 has charging receptacle 1018. Charging tube 1020 connects between charging receptacle 1018 and tail fuze system 1024. This charge tube is eliminated on some PW. End 1012 of cylindrical-shaped, rear section 1010 has opening 1016 that receives tail fuze system 1024 and aft-end closure structure 1026. End 1012 of cylindrical-shaped, rear section 1010 has threaded opening 1016 that receives tail fuze system 1024 and closure structure 1026 that preferably is threaded into opening 1060. A fin assembly (not shown) attaches to aft-end closure structure 1012. In the finished bomb, as stated, the interior cavity of the bomb casing is filled with high explosive material.

Like FIG. 2, cylindrical-shaped, rear section 1010 in FIG. 9 may have an assembly attached to it for receiving the threaded bases of two or more suspension lugs (not shown). The suspension lugs, as stated, are used for lifting the finished bombs and attaching them to aircraft wing bomb mounts.

Figure 11A:
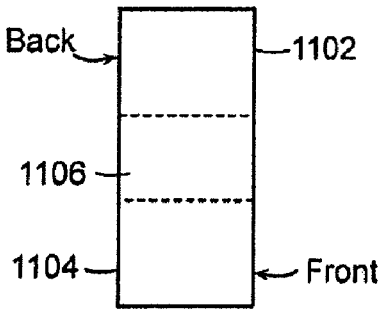
FIG. 11A (Prior Art)
FIGS. 11A and 11B shows views of a conventional fuse booster that is used in fuse systems.
Figure 11B:
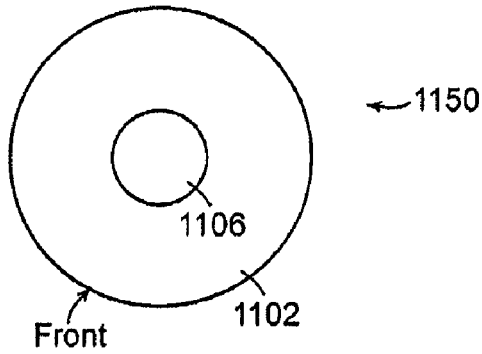
FIG. 11B (Prior Art)

Referring to FIGS. 11A and 11B, some generally at 1100 and 1150, respectively, a conventional fuse booster that is included in a conventional fuse system will be described. A conventional fuse booster, such as that shown at 1100 and 1150 is in the shape of a cylindrical disk. This disk can be of various sizes and made of various types of high explosive material. This fuse booster has front 1102 and back 1104. This fuse booster typically is placed in the front portion of the fuse and because of this it will have taken 1106 at the center through which electrical wires pass for making electric connections to the fuse. Some new fuse boosters, however, do not require the center hole because all the electrical wiring and connectors are in the aft end of the fuse.

Whether the conventional fuse booster is one that has a hole at the center or not, it is initiated from the backside by a detonator/igniter. When the booster is ignited, its role is to set off the main charge contained within the bomb or warhead.

A problem that arises with conventional bombs or penetrating warheads at the time of a penetrating event is that the explosive charge can compress and when the booster is initiated due to the air gap that is formed between the booster and the main charge, the booster will not set off the main charge and the weapon will not function as desired. Another problem that arises when using a conventional fuse booster, such as shown at FIGS. 11A and 11B, there is no control as to how the fuse booster ignites the main high explosive charge.

According to the present invention, a shaped charge booster of various designs can be used to control the method by which the high explosive within the bomb or warhead casing is ignited by the shaped charge booster. As such, the collateral damage that the bomb or penetrating warhead delivers at the target is controlled. Although, FIGS. 12-21 show a number of different designs, these are examples and are not meant to limit the present invention. These examples are provided for the sole purpose of demonstrating that different designs may be used to control the collateral damage that will be delivered at a target.

Figure 12A:
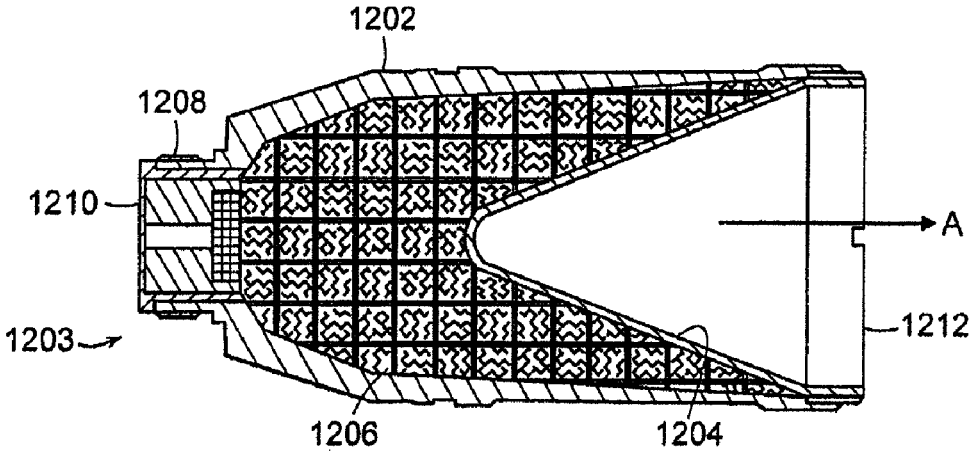
FIG. 12A (Prior Art)
FIG. 12A shows a cross-sectional view of a conventional shaped charge that is used in a conventional bomb or conventional penetrating warhead bomb casing.

FIG. 12A, generally at 1200, is a cross-section view of a conventional shaped charge that may be used in a bomb or warhead. The shaped charge that is shown here is not for use in a fuse system but within a bomb structure. The conventional shaped charge as outer casing 1202, conical metal liner 1204, and high explosive 1206 between the outer casing 1202 and conical metal liner 1204. Conical metal liner 1204 is held in position by retainer ring 1212. Outer casing 1202 has raised section 1208 that receives detonator 1210. When the detonator initiates the high explosive, a jet is formed at exits charge in direction "A" shown in the Figure. The jet is used for piercing targets.

Again referring to FIG. 12A, according to the present invention, the shaped charge structure that is generally shown in this Figure is used to replace the conventional fuse booster that is shown, for example, in FIGS. 11A and 11B. This will be shown and described in more detail with respect to FIG. 12B.

Figure 12B:
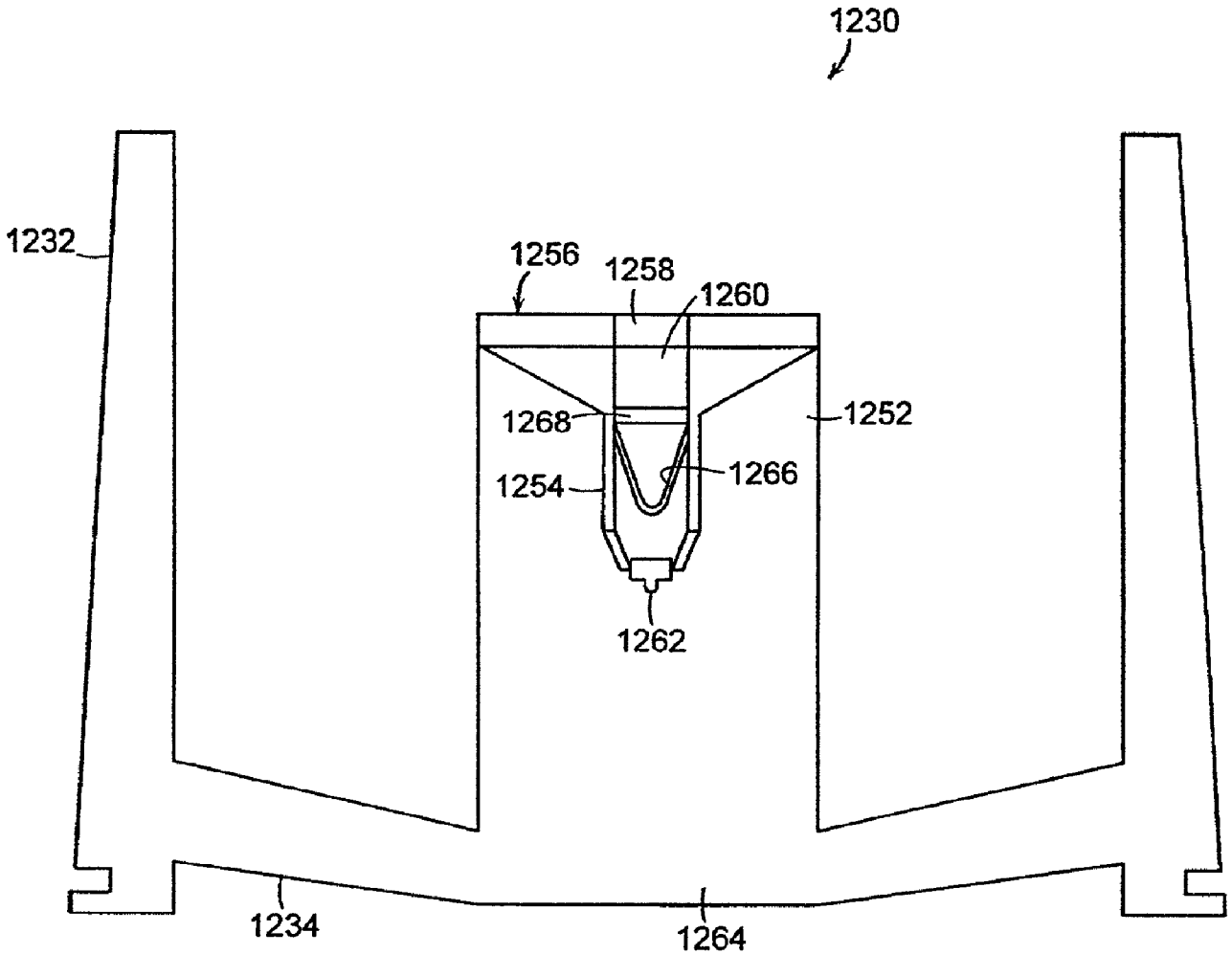
FIG. 12B shows a cross-sectional view of a bomb casing with a fuse system according to the present invention that includes a first embodiment of a shaped charge.

FIG. 12B, generally at 1230, shows the shaped charge in FIG. 12A disposed according to the present invention in a fuse system of a bomb or penetrating warhead casing. According to FIG. 12B, preferably, fuse system 1252 is threaded in end enclosure 1234, which is threaded to the tail section of bomb or penetrating warhead casing 1232. As shown, the fuse system has shaped charge 1254 disposed in it.

The fuse system has shaped charge holder 1256 that includes base plate 1258 and opening 1260 for receiving the shaped charge. Conical metal liner 1266 is held in place within opening 1256 by retainer ring 1268. With the holder being present, the aluminum casing that is shown in FIG. 12A is not needed.

Detonator 1262 is fixed at the opposite end of opening 1260. Because of air gap 1264 in the fuse system, there will be a delay in the initiation of the shaped charge that will in turn initiate the main high explosive charge within the bomb or penetrating warhead casing. The structure of the shaped charge will also determine how the main high explosive will be charge initiated because of the form of the jet that is created.

Although conical liner 1266 has been described as being made of metal, e.g., copper, it is understood that if the made of another material and still be within the scope of the present invention as long as it will permit the appropriate jet to be formed for igniting the main high explosives charge.

Figure 13:
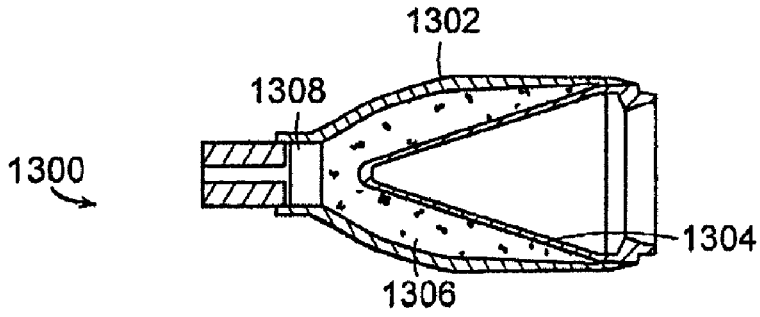
FIG. 13 shows a cross-sectional view of a second embodiment of a shaped charge for use in a fuse system according to the present invention.

Referring to FIG. 13, generally at 1300, a second embodiment of the shaped charge for use in a fuse system is shown. The opening in the shaped charge holder of the fuse system that receives shaped charge 1300 will have an internal form similar to outer structure 1302. Shaped charge 1300 has conical metal liner 1304 that extends a substantial length of the shaped charge reducing the amount of high explosives 1306 within the shaped charge. It is also to be noted that conical metal liner has a different shape than the one shown in FIG. 12B. This will mean that the jet formed will be different.

Detonator 1308 is positioned in a manner similar to detonator 1262 in FIG. 12B. Also similar to FIG. 12B, conical metal liner 1304 will be held in place by a retainer ring and the bomb detonation sequence will be similar to that described before with regard to there of being a delay in the initiation of the main high explosive charge. However, the shape of the shaped charge will ignite the main high explosive charge in a predetermined manner given that the conical metal liner has a constant angle and a uniform thickness.

Figure 14:
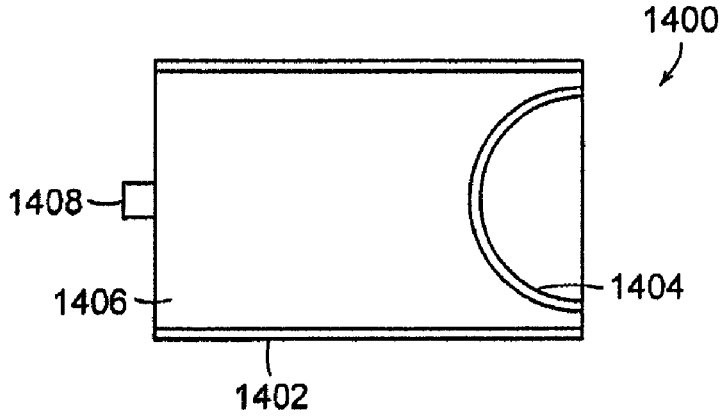
FIG. 14 shows a cross-sectional view of a third embodiment of a shaped charge for use in a fuse system according to the present invention.

FIG. 14, generally at 1400, shows a third embodiment of the shaped charge for use in a fuse system is shown. The opening in the shaped charge holder of the fuse system that receives shaped charge 1400 will have an internal form similar to outer structure 1402. Shaped charge 1400 has hemispherical metal liner 1404. High explosives 1408 is disposed between the hemispherical metal liner and the outer structure 1402.

Detonator 1406 is positioned in a manner similar to detonator 1262 in FIG. 12B. Also similar to FIG. 12B, hemispherical metal liner 1304 will be held in place by a retainer ring and the bomb detonation sequence will be similar to that described before with regard to there of being a delay in the initiation of the main high explosive charge. However, the hemispherical shape of the shaped charge will ignite the main high explosive charge in a predetermined manner given its shape and it having a uniform thickness.

A preferred use of the shape charge shown in FIG. 14 is when a shaped charge such as is shown in FIGS. 12B and 13 does not provide a large the shock wave to ignite the main high explosive charge.

Figure 15:
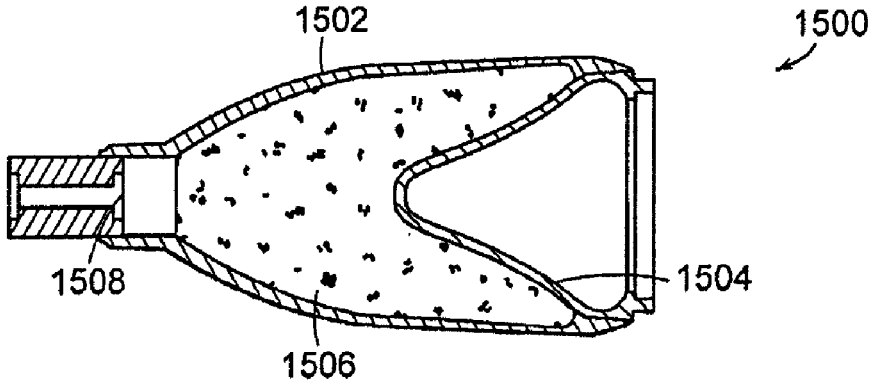
FIG. 15 shows a cross-sectional view of a fourth embodiment of a shaped charge for use in a fuse system according to the present invention.

FIG. 15, generally at 1500, shows a fourth embodiment of the shaped charge for use in a fuse system is shown. The opening in the shaped charge holder of the fuse system that receives shaped charge 1500 will have an internal form similar to outer structure 1502. Shaped charge 1500 has trumpet metal liner 1504. High explosives 1506 is disposed between the trumpet metal liner and the outer structure 1502.

Detonator 1508 is positioned in a manner similar to detonator 1262 in FIG. 12B. Also similar to FIG. 12B, trumpet metal liner 1504 will be held in place by a retainer ring and the bomb detonation sequence will be similar to that described before with regard to there of being a delay in the initiation of the main high explosive charge. However, the trumpet shape of the shaped charge will ignite the main high explosive charge in a predetermined manner given its shape and it having a uniform thickness.

A preferred use of the shape charge shown in FIG. 15 is when is desired to provide more molten metal to ignite the main high explosive charge.

Figure 16:
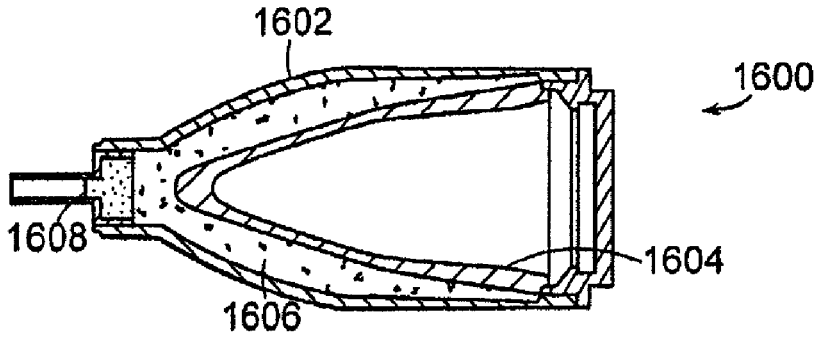
FIG. 16 shows a cross-sectional view of a fifth embodiment of a shaped charge for use in a fuse system according to the present invention.

FIG. 16, generally at 1600, shows a fifth embodiment of the shaped charge for use in a fuse system is shown. The opening in the shaped charge holder of the fuse system that receives shaped charge 1600 will have an internal form similar to outer structure 1602. Shaped charge 1600 has stepped, conical metal liner 1604. High explosives 1606 is disposed between the stepped, conical metal liner and the outer structure 1602.

Detonator 1608 is positioned in a manner similar to detonator 1262 in FIG. 12B. Also similar to FIG. 12B, stepped, conical metal liner 1604 will be held in place by a retainer ring and the bomb detonation sequence will be similar to that described before with regard to there of being a delay in the initiation of the main high explosive charge. The stepped, conical shape of the shaped charge will ignite the main high explosive charge in a predetermined manner given its shape and it having a non-uniform thickness.

Figure 17:
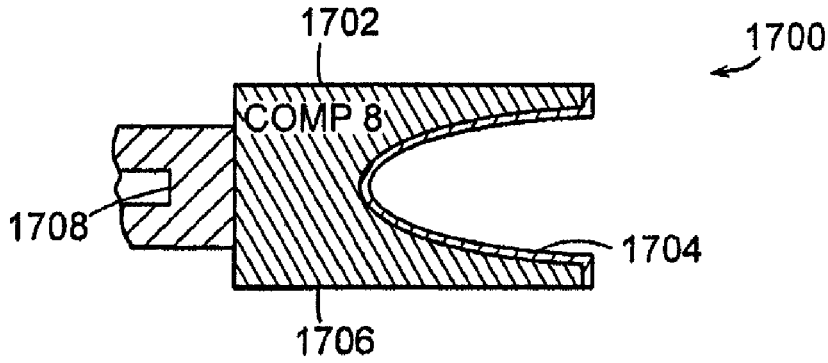
FIG. 17 shows a cross-sectional view of a sixth embodiment of a shaped charge for use in a fuse system according to the present invention.

FIG. 17, generally at 1700, shows a sixth embodiment of the shaped charge for use in a fuse system is shown. The opening in the shaped charge holder of the fuse system that receives shaped charge 1700 will have an internal form similar to outer structure 1702. Shaped charge 1600 has tulip metal liner 1704. High explosives 1706 is disposed between the tulip metal liner and the outer structure 1702.

Detonator the 1708 is positioned in a manner similar to detonator 1262 in FIG. 12B. Also similar to FIG. 12B, tulip metal liner 1704 will be held in place by a retainer ring and the bomb detonation sequence will be similar to that described before with regard to there of being a delay in the initiation of the main high explosive charge. The tulip shape of the shaped charge will ignite the main high explosive charge in a predetermined manner given its shape and it having a non-uniform thickness.

Figure 18:
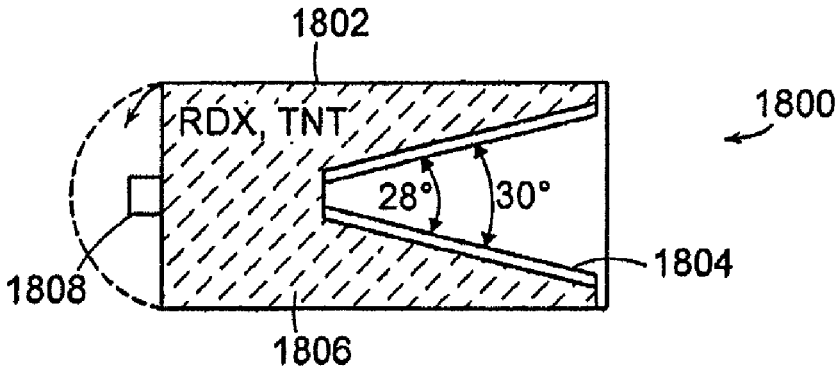
FIG. 18 shows a cross-sectional view of a seventh embodiment of a shaped charge for use in a fuse system according to the present invention.

FIG. 18, generally at 1800, shows a seventh embodiment of the shaped charge for use in a fuse system is shown. The opening in the shaped charge holder of the fuse system that receives shaped charge 1800 will have an internal form similar to outer structure 1802. Shaped charge 1800 has tapered conical metal liner 1804. High explosives 1806 is disposed between the tapered conical metal liner and the outer structure 1602.

Detonator 1808 is positioned in a manner similar to detonator 1262 in FIG. 12B. Also similar to FIG. 12B, tapered conical metal liner 1804 will be held in place by a retainer ring and the bomb detonation sequence will be similar to that described before with regard to there of being a delay in the initiation of the main high explosive charge. The tapered conical shape of the shaped charge will ignite the main high explosive charge in a predetermined manner given its shape and it having a non-uniform thickness.

Figure 19:
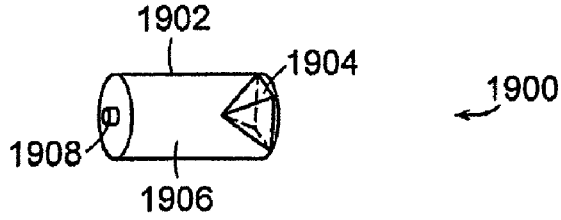
FIG. 19 shows a cross-sectional view of an eighth embodiment of a shaped charge for use in a fuse system according to the present invention.

FIG. 19, generally at 1900, shows an eighth embodiment of the shaped charge for use in a fuse system is shown. The opening in the shaped charge holder of the fuse system that receives shaped charge 1900 will have an internal form similar to outer structure 1902. Shaped charge 1900 has pyramidal metal liner 1904. High explosives the 1906 is disposed between the pyramidal metal liner and the outer structure a 1902.

Detonator 1908 is positioned in a manner similar to detonator 1262 in FIG. 12B. Also similar to FIG. 12B, pyramidal metal liner svelte 1904 will be held in place by a retainer ring and the bomb detonation sequence will be similar to that described before with regard to there of being a delay in the initiation of the main high explosive charge. The pyramidal shape of the shaped charge will ignite the main high explosive charge in a predetermined manner given its shape and a non-uniform thickness of the charge around the liner because of its pyramidal shape.

Preferably, the stepped, conical shape; tulip shape; tapered conical shape; and pyramidal shape of the shaped charge will be used when different characteristics are desired for ignition of the main high explosive charge or to accommodate the use of different materials for the liners. These may also be desire to be used to accommodate the properties of various types of high explosive material that may be used for the main high explosive charge.

Figure 20:
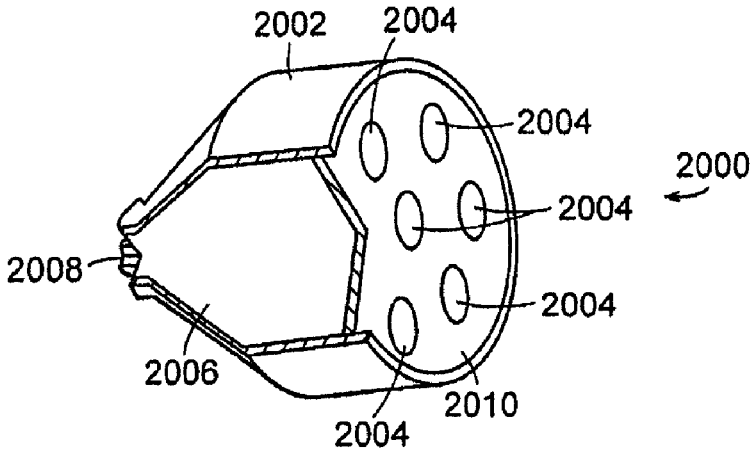
FIG. 20 shows a cross-sectional view of a ninth embodiment of a shaped charge for use in a fuse system according to the present invention.

FIG. 20, generally at 2000, shows a ninth embodiment of the shaped charge for use in a fuse system is shown. The opening in the shaped charge holder of the fuse system that receives shaped charge 2000 will have an internal form similar to outer structure 2002. Shaped charge 2000 has multiple metal liners 2004 on closure structure 2010. High explosives 2006 is disposed between the multiple metal liners and the outer structure 2002.

Detonator 2008 is positioned in a manner similar to detonator 1262 in FIG. 12B. Closure structure 2010 in which the multiple metal liners 2004 are disposed will be held in place by a retainer ring and the bomb detonation sequence will be similar to that described before with regard to there of being a delay in the initiation of the main high explosive charge. The number, size, and shape of the fuse liners of the shaped charge will ignite the main high explosive charge in a predetermined manner.

Figure 21:
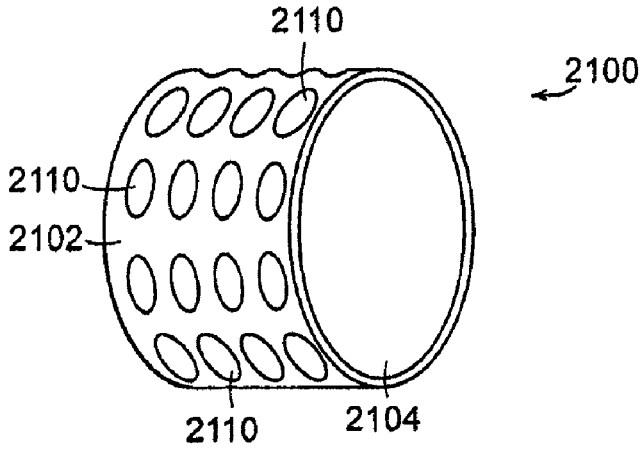
FIG. 21 shows a cross-sectional view of a tenth embodiment of a shaped charge for use in a fuse system according to the present invention.

FIG. 21, generally at 2100, shows a tenth embodiment of the shaped charge for use in a fuse system is shown. The opening in the shaped charge holder of the fuse system that receives shaped charge 2100 will have a internal form to accommodate outer structure 2102 that has multiple metal liners 2110 disposed in it. The shaped charge of this embodiment has an end member 2104 that closes the shaped charge. High explosives (not shown) are is disposed within the shaped charge. A detonator (not shown) is positioned in a manner similar to detonator 1262 in FIG. 12B. End member 2104 is held in place by a retainer ring and the bomb detonation sequence will be similar to that described before with regard to there of being a delay in the initiation of the main high explosive charge. The number, size, and shape of the fuse liners of the shaped charge will ignite the main high explosive charge in a predetermined manner.

Preferably, the multiple liner shaped charges that are shown in FIGS. 20 and 21 will be used when the main high explosives are hard to ignite and there is a desire control the intensity of the resulting explosive blast.

The terms and expressions which are used herein are used as terms of expression and not of limitation. And, there is no intention, in the use of such terms and expressions, of excluding the equivalents of the features shown and described, or portions thereof, it being recognized that various modifications are possible in the scope of the invention.

The invention claimed is:

1. A reduced collateral damage bomb casing system, comprising:

(A) a tapering cylindrical shaped front section of the bomb casing that includes a closed front end and an open aft-end, and front section having a first interior opening, with the front section further having a progressively decreasing wall thickness from the front end to the open aft-end;

(B) a substantially uniform cylindrical shaped rear section of the bomb casing that includes a front edge that interfaces with the aft-end of the front section, and open aft-end, and the rear section having a second interior opening, with the rear section further having a substantially uniform wall thickness from the front edge to the open aft-end, with the front and rear sections forming an integrated, single unit bomb casing and the first and second openings combining to form an interior cavity for the bomb casing;

(C) high explosive material disposed in the interior cavity;

(D) a fuse system receiving structure disposed within the interior cavity;

(E) a plurality of fuse system types for disposition in the fuse system receiving structure one at a time, with each of the plurality of fuse systems containing a different shaped charge for igniting the high explosive material in a different controlled manner to control an amount of collateral damage cause by a bomb employing the bomb casing system.

2. The bomb casing system as recited in claim 1, wherein the tapering cylindrical shaped front section includes ogive-shaped front section.

3. The bomb casing system as recited in claim 1, wherein the wall thickness of the front section at the aft-end is substantially the same as the wall thickness of the rear section at the front-end where the front and rear sections interface.

4. The bomb casing system as recited in claim 1, wherein the bomb casing includes a bomb casing including an ogive-shaped front section and a cylindrical-shaped rear section.

5. The bomb casing system as recited in claim 1, wherein the bomb casing includes a penetrating warhead bomb casing.

6. The bomb casing system as recited in claim 1, wherein the interior channel includes a cylindrical channel.

7. The bomb casing system as recited in claim 6, wherein the interior channel has a substantially uniform diameter along its length.

8. The bomb casing system as recited in claim 1, wherein the shaped charge includes at least fuse liner, explosive material and a detonator.

9. The bomb casing system as recited in claim 8, wherein the fuse liner has a conical shape.

10. The bomb casing system as recited in claim 8, wherein the fuse liner has a stepped, conical shape.

11. The bomb casing system as recited in claim 8, wherein the fuse liner has a tulip shape.

12. The bomb casing system as recited in claim 8, wherein the fuse liner has a trumpet shape.

13. The bomb casing system as recited in claim 8, wherein the fuse liner has a hemispherical shape.

14. The bomb casing system as recited in claim 8, wherein the fuse liner has a tapered conical shape.

15. The bomb casing system as recited in claim 8, wherein the fuse liner has a pyramidal shape.

* * * * *